US007083131B2

(12) United States Patent
Ting

(10) Patent No.: US 7,083,131 B2
(45) Date of Patent: Aug. 1, 2006

(54) PAPER SHREDDER

(76) Inventor: Tsung-Pin Ting, No. 669, Ruey Kuang Road, Neihu, Taipei (TW)

( * ) Notice: Subject to any disclaimer, the term of this patent is extended or adjusted under 35 U.S.C. 154(b) by 0 days.

(21) Appl. No.: 10/958,365

(22) Filed: Oct. 6, 2004

(65) Prior Publication Data

US 2005/0072869 A1 Apr. 7, 2005

(30) Foreign Application Priority Data

Oct. 7, 2003 (TW) ..... 92127855 A

(51) Int. Cl.
*B02C 18/16* (2006.01)

(52) U.S. Cl. ..... 241/100; 241/236; 241/285.3

(58) Field of Classification Search ..... 241/236, 241/100, 285.3
See application file for complete search history.

(56) References Cited

FOREIGN PATENT DOCUMENTS

| | | |
|---|---|---|
| DE | 3607752 | * 10/1987 |
| DE | 29622139 | * 4/1997 |
| DE | 19618478 | * 9/1997 |

* cited by examiner

*Primary Examiner*—Mark Rosenbaum
(74) *Attorney, Agent, or Firm*—Berkeley Law & Technology Group, LLC

(57) ABSTRACT

A paper shredder includes a shred container having an open end formed with two opposite pivot seats, and a shredder cover provided with two pivot members at two opposite sides thereof. The pivot members are mounted on the pivot seats of the shred container such that the shredder cover is turnable about the axes of the pivot members.

7 Claims, 5 Drawing Sheets

PAPER SHREDDER

FIELD OF THE INVENTION

The present invention relates to a paper shredder, specifically to a paper shredder having a shred container and a shredder cover that is disposed on the shred container and that is turnable relative to the shred container.

BACKGROUND OF THE INVENTION

Some papers, which contain high important information and secrets, need to be eliminated so as not to leak out the information and secrets. A paper shredder is generally used to shred a sheet of paper into tiny pieces so that information written thereon cannot be traced or recognized at all.

Referring to FIG. 1, a conventional paper shredder 2 is shown to include a shred container 6 and a shredder cover 4. The shred container 6 defines a receiving space therein. The shredder cover 4 is mounted on a top end of the shred container 6, includes a shredder 8, and defines a paper entrance 12 at an upper side of the shredder 8, and a paper exit at a lower side of the shredder 8. The paper exit of the shredder cover 4 is in spatial communication with the receiving space in the shred container 6 such that the tiny shreds of the paper fed through the shredder 8 are collected in the shred container 6.

Some of the disadvantages resulting from the use of aforesaid conventional paper shredder are as follows:

(i) The shredder cover 4 easily disengages and falls off the shred container 6 because the shredder cover 4 itself is relatively heavy and by virtue of the unbalance weight of the shredder 8, thereby spilling the waste to an ambient surrounding of the shred container 6.

(ii) In order to avoid falling of the shredder cover 4 from the shred container 6, a known hook-and-loop fastening device can be mounted on the connecting ends of the shredder cover 4 and the shred container 6 for coupling the same. Whenever the user wishes to remove waste from the shred container 6, he needs to conduct several pressing steps so as to remove the hooks from the loops. This is inconvenient to the user.

(iii) The hooks, generally made from plastic material, are subjected to deform due to long term use and thus hinder in smooth removal from the loops.

(iv) Screws and bolts can be employed to couple the shredder cover 4 and the shred container 6. Detachment of screws one after another is laborious and time-consuming.

SUMMARY OF THE INVENTION

The object of the present invention is to provide a paper shredder having a shredder cover mounted turnably on a shred container. The paper shredder can eliminate the aforesaid disadvantages that result from the use of the conventional paper shredder.

A paper shredder of the present invention includes: a shredder cover including a shredder for shredding paper, the shredder cover having an upper face formed with a paper entrance and a lower face formed with a paper exit, the shredder cover further having two opposite sides interconnecting the upper and lower faces and two pivot members provided respectively on the opposite sides; and a shred container disposed below the shredder cover to receive shreds from the shredder, the shred container having an open end which includes two opposite edges respectively provided with pivot seats, the pivot members being mounted respectively on the pivot seats so that the shredder cover is mounted on the shred container. The shredder cover is turnable about the axes of the pivot members.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 4(B) is an enlarged view, illustrating one of two opposite sides of the shredder cover of the second preferred embodiment; and FIG. 4(C) is an enlarged view, illustrating one of two pivot seats mounted on an open end of a shred container of the second preferred embodiment.

DETAILED DESCRIPTION OF THE PREFERRED EMBODIMENTS

Figure 1:
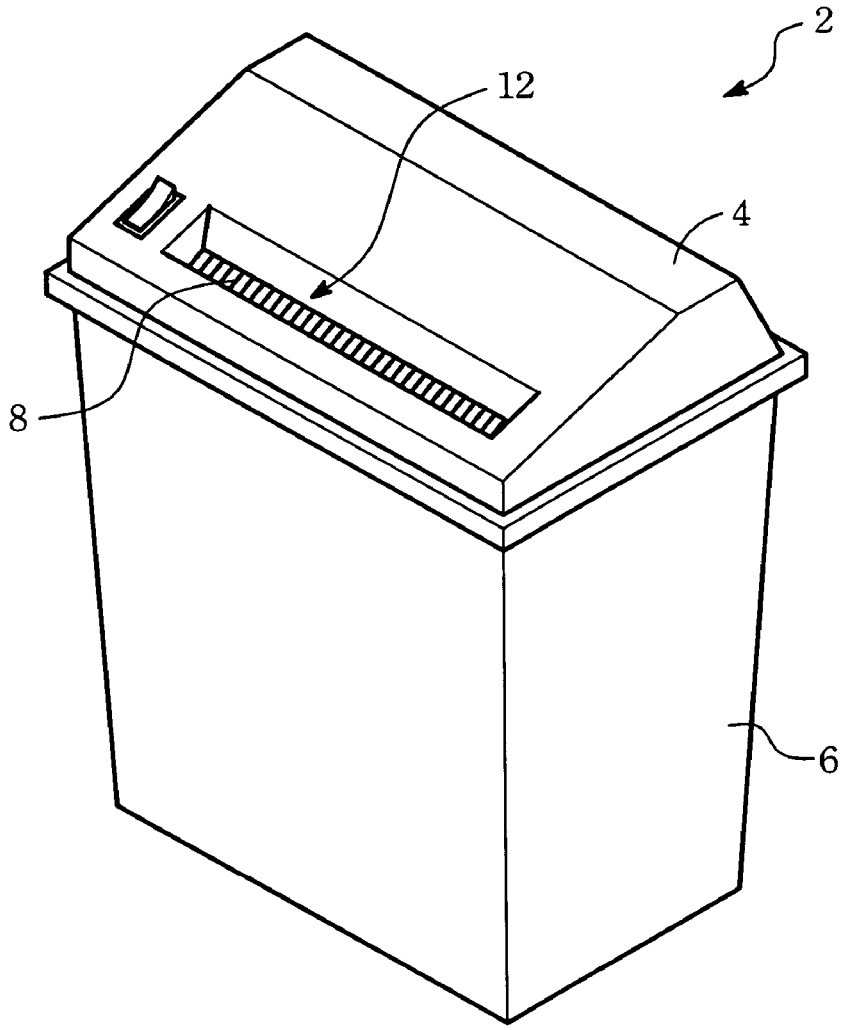
Fig. 1 (Prior Art)
FIG. 1 is a perspective view of a conventional paper shredder.

Before the present invention is described in greater detail with reference to the following preferred embodiments, it should be noted that same reference numerals have been used to denote similar elements throughout the specification.

Figure 2A:
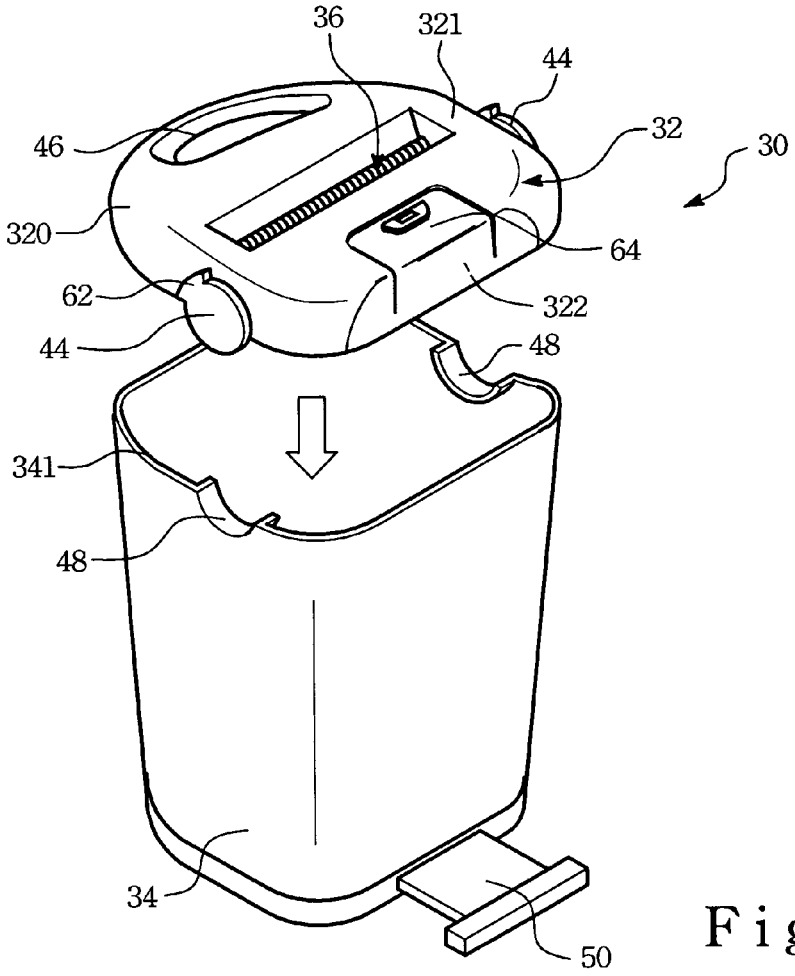
FIG. 2(A) is an exploded perspective view of the first preferred embodiment of a paper shredder according to the present invention.
Figure 2B:
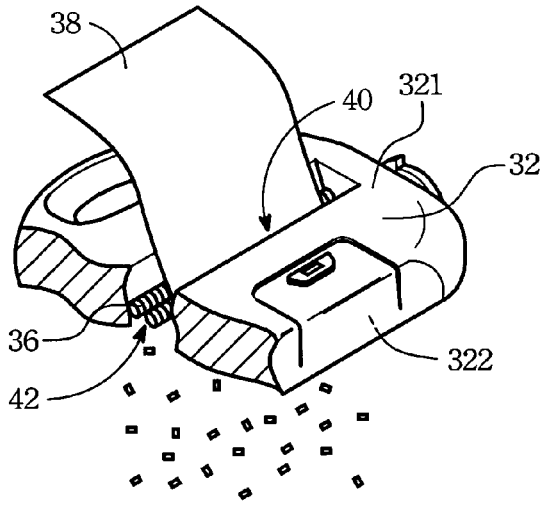
FIG. 2(B) is a fragmentary sectional view, illustrating how a sheet of paper is fed through a shredder cover of the first preferred embodiment of the present invention.

Referring to FIGS. 2(A) and 2(B), the first preferred embodiment of a paper shredder 30 according to the present invention is shown to include a shredder cover 32 and a shred container 34, As illustrated, the shredder cover 32 includes a shredder 36 for shredding a piece of paper 38, and has an upper face 321 formed with a paper entrance 40 and a lower face 322 formed with a paper exit 42. The shredder cover 32 further has two opposite sides 320 interconnecting the upper and lower faces (321,322), and two pivot members 44 provided respectively on the opposite sides 320.

The shred container 34 is disposed below the shredder cover 32 to receive shreds from the shredder 36, and has a top open end 341, which includes two opposite edges respectively provided with pivot seats 48.

The pivot members 44 of the shredder cover 32 are mounted respectively on the pivot seats 48 of the shred container 34 so that the shredder cover 32 is mounted on the shred container 34 and the shredder cover 32 is turnable about the axes of the pivot members 44.

A handle 46 is disposed at one side of the pivot members 44 which are symmetrically opposite to each other. The handle 46 is used as the point of force application for turning and opening the shredder cover 32 such that the shredder cover 32 can be rotated about the axes of the pivot members 44 between an open position, in which the shredder cover 32 is turned to an angular position (see FIG. 4(A)) so as to expose the open end 341 of the shred container 34 to permit access to the shred container 34, and a closed position, in which the shredder cover 32 covers the open end 341 of the shred container 34 (see FIG. 3(A)).

Preferably, an on/off switch 64 is disposed on the shredder cover 32 at the other side of the pivot members 44, is opposite to the handle 46, and is electrically connected to the shredder 36 for activating and de-activating the shredder 36.

In this preferred embodiment, each of the pivot seats 48 is in the form of a curved wall that is indented downwardly from the top open end 341 of the shred container 34 and that has two opposite edges. Each of the pivot members 44 is generally cylindrical in cross-section. The shredder cover 32 further includes a pair of rotation limiting members 62, each of which projects radially and outwardly from a circumferential portion of a respective one of the pivot members 44, and each of which abuts against one of two opposite edges of a respective one of the pivot seats 48 so as to restrict angular rotation of the shredder cover 32 relative to the shred container 34 when the shredder cover 32 is turned to the open position (see FIG. 4(A)).

A ground propping member 50 projects transversely from a bottom end of the shred container 34, and is disposed opposite to the handle 46 such that the ground propping member 50 can abut against an adjacent ground surface supporting the shred container 34 (not shown) due to inclination of the shred container 34 with respect to the adjacent ground surface during removal of the shredder cover 32 from the shred container 34 by gripping the handle 46.

Figure 3A:
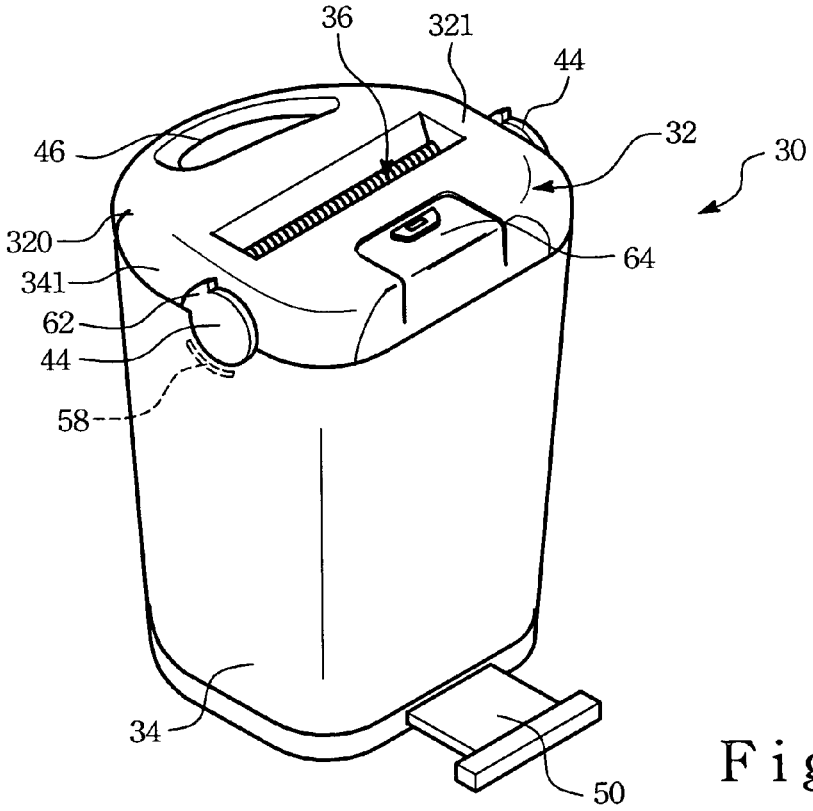
FIG. 3(A) is a perspective view of the second preferred embodiment of the paper shredder according to the present invention.
Figure 4A:
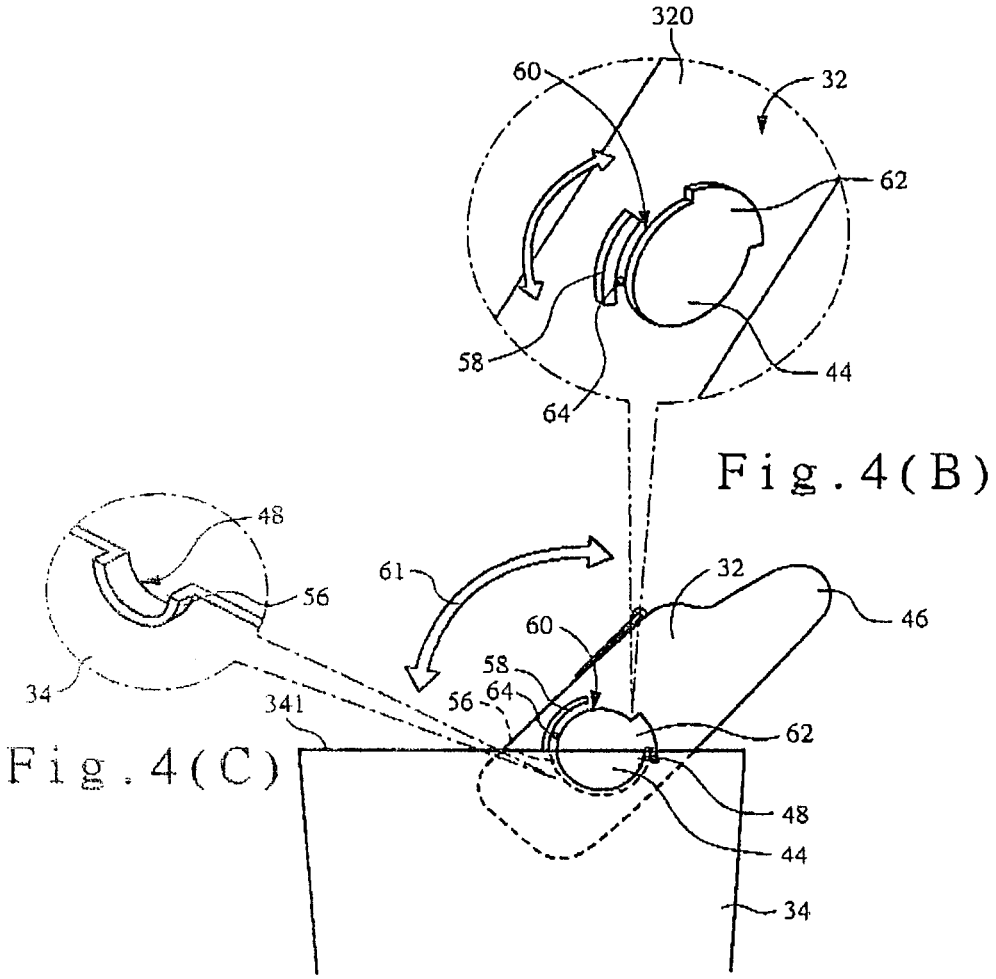
FIG. 4(A) is a fragmentary view, illustrating the shredder cover of the second preferred embodiment is turned to an open position.

Referring to FIGS. 3(A) and 4(A), the second preferred embodiment of the present invention includes a pair of curved blocks 58 (see FIG. 4(B)), each of which is fixed on one of the opposite sides 320 of the shredder cover 32 and each of which cooperates with a respective one of the pivot members 44 to define a clearance 60 therebetween. The shred container 34 further includes a pair of stop members 56 of sector-shaped configuration (see FIGS. 3(A) and 4(C)), each of which is integrally formed with a respective one of the pivot seats 48, and projects transversely and inwardly into the shred container 34. When the shredder cover 32 is disposed at the closed position, the stop members 56 respectively extend into the clearances 60 of the shredder cover 32 so as to prevent untimely and undesired removal of the shredder cover 32 from the shred container 34. When the shredder cover 32 is turned to the open position (see FIG. 4A)), the curved blocks 58 of the shredder cover 32 are respectively disposed at an elevation above the stop members 56 of the shred container 34 so as to permit removal of the shredder cover 32 from the shred container 34.

Figure 3B:
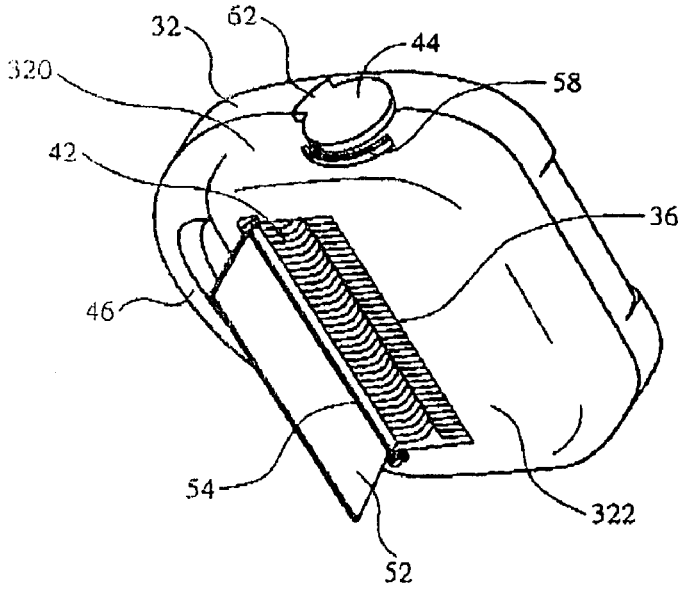
FIG. 3(B) is a perspective view of a modified shredder cover employed in the second preferred embodiment.
Figure 3C:
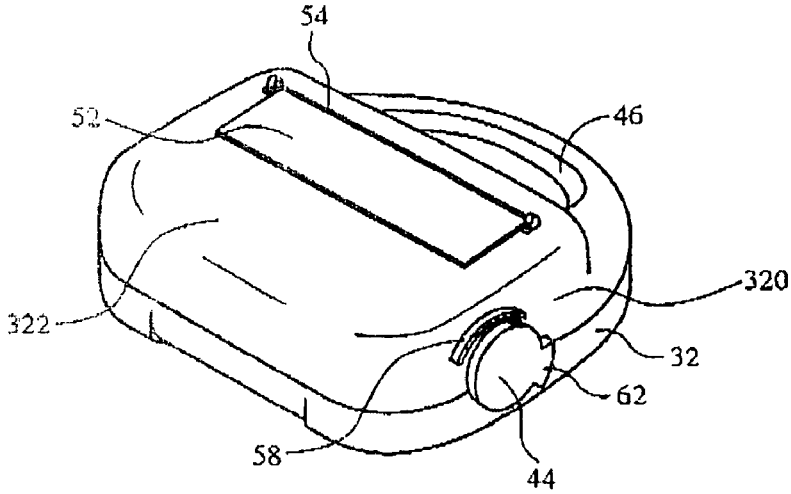
FIG. 3(C) is s a perspective view of the modified shredder cover when turned upside down.

Referring to FIGS. 3(B) and 3(C), a modified shredder cover 32 can be used in the second preferred embodiment, and includes a mounting shaft 54 and a protective shield 52. The mounting shaft 54 is fixed on the lower face 322 of the shredder cover 32 adjacent to the paper exit 42. The protective shield 52 is pivoted on the shredder cover 32 via the mounting shaft 54 in such a manner that the protective shield 52 covers and conceals the shredder 36 there underneath so as to prevent a user from contacting, thereby injuring the user when the shredder cover 32 is turned to the open position (see FIG. 4(A)). When the shredder cover 32 is disposed at the closed position, the protective shield 52 dangles into the shred container 34 by virtue of weight gravity [see FIG. 3(B)].

The benefits of this invention are:

(1) No hook-and-loop device is employed in the preferred embodiment. There is no problem of deformation of the pivot members 44 and the pivot seats 48.

(2) Assembly and disassembly of the shredder cover 32 onto and from the shred container 34 is easy to perform.

(3) Removal of waste from the shred container is easy due to easy detachment of the shredder cover 32 from the shred container 34.

As is understood by a person skilled in the art, the foregoing preferred embodiment of the present invention is an illustration of the present invention rather than limiting thereon. It is intended to cover various modifications and similar arrangements included within the spirit and scope of the appended claims, the scope of which should be accorded the broadest interpretation so as to encompass all such modifications and similar structure.

I claim:

1. A paper shredder comprising:

a shredder cover including a shredder for shredding paper, said shredder cover having an upper face formed with a paper entrance and a lower face formed with a paper exit, said shredder cover further having two opposite sides interconnecting said upper and lower faces and two pivot members provided respectively on said opposite sides; and a shred container disposed below said shredder cover to receive shreds from said shredder, said shred container having an open end which includes two opposite edges respectively provided with pivot seats, said pivot members being mounted respectively on said pivot seats so that said shredder cover is mounted on said shred container and said shredder cover is turnable about the axes of said pivot members, wherein each of said pivot seats is in the form of a curved wall that is indented downwardly from said open end of said shred container, each of said pivot members being generally cylindrical in cross-section, said shredder cover further comprising a pair of rotation limiting members, each of which projects radially and outwardly from a circumferential portion of a respective one of said pivot members, and each of which is adapted to abut against one of two opposite edges of a respective one of said pivot seats so as to restrict angular rotation of said shredder cover relative to said shred container when said shredder cover is turned to said open position.

2. The paper shredder according to claim 1, wherein said shredder cover includes a handle at one side of said pivot members which are symmetrically opposite to each other, said handle capable of being used as the point of force application for turning and opening said shredder cover, whereby said shredder cover is rotated about the axes of said pivot members.

3. The paper shredder according to claim 2, wherein said shredder cover is movable between open and closed positions by rotating said shredder cover about the axes of said pivot members, when the shredder cover is located in the open position, an end of said shredder cover is rotated upwardly exposing said open end of said shred container permitting access to an interior of said shred container, and, when said shredder cover is located in the closed position, said shredder cover covering the open end of said shred container.

4. The paper shredder according to claim 1, further comprising a ground propping member projecting transversely from a bottom end of said shred container and opposite to said handle such that said ground propping member can abut against an adjacent ground surface supporting said shred container due to inclination of said shred container with respect to the adjacent ground surface during removal of said shredder cover from said shred container by gripping said handle.

5. The paper shredder according to claim 4, further comprising a mounting shaft fixed on said lower face of said shredder cover adjacent to said paper exit, and a protective shield pivoted on said shredder cover via said mounting shaft in such a manner that said protective shield covers and conceals said shredder there underneath so as to prevent a user from contacting, thereby injuring the user when said shredder cover is turned to said open position and that said protective shield dangles into said shred container by virtue of weight gravity when said shredder cover is disposed at said closed position.

6. The paper shredder according to claim 5, further comprising a pair of curved blocks, each of which is fixed on one of said opposite sides of said shredder cover and each of which cooperates with a respective one of said pivot members to define a clearance therebetween, said shred container further comprising a pair of stop members of sector-shaped configuration, each of which is integrally formed with a respective one of said pivot seats and projecting transversely and inwardly into in said shred container, said stop members respectively extending into said clearances of said shredder cover so as to prevent untimely and undesired removal of said shredder cover from said shred container when said shredder cover is disposed at an elevation above said stop members of said shred container so as to permit removal of said shredder cover from said shred container when said shredder cover is turned to said open position.

7. The paper shredder according to claim 6, further comprising an on/off switch that is disposed on said shredder cover at the other side of said pivot members, that is opposite to said handle and that is electrically connected to said shredder for activating and de-activating said shredder.

* * * * *